US011053759B2

(12) United States Patent
Covalt et al.

(10) Patent No.: US 11,053,759 B2
(45) Date of Patent: Jul. 6, 2021

(54) COMPACT SETTING TOOL

(71) Applicant: Hunting Titan, Inc., Pampa, TX (US)

(72) Inventors: Johnny Covalt, Burleson, TX (US); Joseph Albert Henke, Hallettsville, TX (US); Roger Griffin, Weatherford, TX (US)

(73) Assignee: Hunting Titan, Inc., Pampa, TX (US)

( * ) Notice: Subject to any disclaimer, the term of this patent is extended or adjusted under 35 U.S.C. 154(b) by 7 days.

(21) Appl. No.: 16/478,107

(22) PCT Filed: Jan. 19, 2018

(86) PCT No.: PCT/US2018/014547

§ 371 (c)(1),
(2) Date: Jul. 15, 2019

(87) PCT Pub. No.: WO2018/136808

PCT Pub. Date: Jul. 26, 2018

(65) Prior Publication Data

US 2019/0368293 A1 Dec. 5, 2019

Related U.S. Application Data

(60) Provisional application No. 62/448,236, filed on Jan. 19, 2017.

(51) Int. Cl.
*E21B 23/06* (2006.01)
*E21B 33/128* (2006.01)

(52) U.S. Cl.
CPC ..... *E21B 23/065* (2013.01); *E21B 33/128* (2013.01)

(58) Field of Classification Search
CPC ... E21B 23/065; E21B 23/0414; E21B 23/042
See application file for complete search history.

(56) References Cited

U.S. PATENT DOCUMENTS

| | | | | |
|---|---|---|---|---|
| 2,701,614 A | | 2/1955 | Ragan et al. | |
| 3,029,873 A | | 4/1962 | Hanes | |
| 3,138,207 A | | 6/1964 | Peppers | |
| 3,237,695 A | | 3/1966 | Bostock et al. | |
| 3,266,575 A | * | 8/1966 | Owen | E21B 23/065 166/63 |
| 3,298,437 A | * | 1/1967 | Conrad | E21B 23/065 166/63 |
| 4,535,842 A | | 8/1985 | Ross | |
| 5,346,014 A | | 9/1994 | Ross | |
| 5,447,202 A | * | 9/1995 | Littleford | E21B 41/00 166/381 |
| 10,538,981 B2 | * | 1/2020 | Covalt | E21B 23/065 |

(Continued)

FOREIGN PATENT DOCUMENTS

WO 9421882 A1 9/1994

OTHER PUBLICATIONS

Communication with Supplementary European Search Report, EP18741139.2, dated Sep. 8, 2020, 6 pages.

(Continued)

*Primary Examiner* — Shane Bomar
(74) *Attorney, Agent, or Firm* — Christopher McKeon; Jason Saunders; Arnold & Saunders, LLP

(57) ABSTRACT

A compact setting tool that sets a packer or bridge plug in a wellbore and then self bleeds the pressure prior to pulling the string out of the wellbore.

31 Claims, 2 Drawing Sheets

(56) References Cited

U.S. PATENT DOCUMENTS

| | | | | |
|---|---|---|---|---|
| 10,844,678 | B2 * | 11/2020 | Mickey | E21B 33/128 |
| 2020/0095838 | A1 * | 3/2020 | Baker | E21B 23/06 |
| 2020/0115979 | A1 * | 4/2020 | Mickey | E21B 33/128 |

OTHER PUBLICATIONS

Office action dated Aug. 25, 2020 from Canadian Intellectual Property Office, Application No. 3,050,712, 4 pages.
Notification of Transmittal of the International Search Report and the Written Opinion of the International Searching Authority, PCT Application No. PCT/US18/14547, dated May 1, 2018, 15 pages.

* cited by examiner

COMPACT SETTING TOOL

RELATED APPLICATIONS

This application claims priority to U.S. Provisional Application No. 62/448,236, filed Jan. 19, 2017.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well known method in the art for accessing hydrocarbon deposits within a formation from a wellbore.

Explosively perforating the formation using a shaped charge is a widely known method for completing an oil well. A shaped charge is a term of art for a device that when detonated generates a focused explosive output. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates the liner metal is compressed into a super-heated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by detonating cord in proximity to a priming hole at the apex of each charge case. Typically, the detonating cord terminates proximate to the ends of the perforating gun. In this arrangement, a detonator at one end of the perforating gun can detonate all of the perforating charges in the gun and continue a ballistic transfer to the opposite end of the gun. In this fashion, numerous perforating guns can be connected end to end with a single detonator detonating all of them.

The detonating cord is typically detonated by a detonator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube, or loading tube that holds the perforating charges. The gun body typically is composed of metal and is cylindrical in shape. Within a typical gun tube is a charge holder designed to hold the shaped charges. Charge holders can be formed as tubes, strips, or chains. The charge holder will contain cutouts called charge holes to house the shaped charges.

Many perforating guns are electrically activated. This requires electrical wiring to at least the firing head for the perforating gun. In many cases, perforating guns are run into the well in strings where guns are activated either singly or in groups, often separate from the activation of other tools in the string, such as setting tools. In these cases, electrical communication must be able to pass through one perforating gun to other tools in the string. Typically, this involves threading at least one wire through the interior of the perforating gun and using the gun body as a ground wire.

Perforating guns and other tools are often connected lowered or conveyed downhole while connected to the surface using a wireline. When pulling the tool back to the surface the tool string may get stuck in the borehole. If too much tension is introduced to the wireline it may fail with a part of the cable falling back into the borehole. Then a fishing tool must be used to grab the loose wireline and pull it back out. This may cause further failures and requires more use of a fishing tool. All of the wireline must be removed before a retrieval tool, such as an overshot style or wash-over style tool, can be used to pull the gun string out itself. This procedure of fishing out the tool may be costly and requires extensive time at the wellsite along with specialized tools.

Releasable tools currently in use may include explosive tools, which use a small booster type explosive to shear a neck, and shear bolts that fail at a predesigned point to allow the wireline to be pulled out of the well intact when a tool string is stuck. Issues with explosive tools may include regulatory issues, transportation issues with the explosive, and the safety concerns of having to pull a live explosive from the wellbore every time the tool string is brought to the surface. Issues with shear bolts is that they may not always fail as designed and an expensive tool may be unnecessarily lost or stuck in the wellbore as a result, or the wireline may still fail because the shear bolts do not function properly Bridge plugs are often introduced or carried into a subterranean oil or gas well on a conduit, such as wire line, electric line, continuous coiled tubing, threaded work string, or the like, for engagement at a pre-selected position within the well along another conduit having an inner smooth inner wall, such as casing. The bridge plug is typically expanded and set into position within the casing. The bridge plug effectively seals off one section of casing from another. Several different completions operations may commence after the bridge plug is set, including perforating and fracturing. Sometimes a series of plugs are set in an operation called "plug and perf" where several sections of casing are perforated sequentially. When the bridge plug is no longer needed the bridge plug is reamed, often though drilling, reestablishing fluid communication with the previously sealed off portion of casing.

Setting a bridge plug typically requires setting a "slip" mechanism that engages and locks the bridge plug with the casing, and energizing the packing element in the case of a bridge plug. This requires large forces, often in excess of 20,000 lbs. The activation or manipulation of some setting tools involves the activation of an energetic material such as an explosive pyrotechnic or black powder charge to provide the energy needed to deform a bridge plug. The energetic material may use a relatively slow burning chemical reaction to generate high pressure gases. One such setting tool is the Model E-4 Wireline Pressure Setting Tool of Baker International Corporation, sometimes referred to as the Baker Setting Tool.

The pressure from the power charge igniting is contained with the power charge chamber by the sealed firing head. The pressure builds in the chamber and causes a floating first piston to move down through the tool, compressing the oil reservoir through a small hole in a connector sub.

The oil is pressed through the small hole in the connector sub and against a second piston. The hydraulic force applied against the second piston causes the piston to move. The second piston is coupled to a setting sleeve by way of a piston rod and sleeve crosslink. The setting sleeve moves away axially from the setting tool and compresses the outside of a bridge plug. A mandrel located down the center of the tool stays stationary. The mandrel is connected to the bridge plug via a shear stud. After the bridge plug is set, the setting tool is pulled upwards in the borehole until sufficient force is generated to shear the shear stud, thus separating the setting tool from the bridge plug.

After the bridge plug is set, the explosive setting tool remains pressurized and must be raised to the surface and depressurized. This typically entails bleeding pressure off the setting tool by piercing a rupture disk or releasing a valve.

SUMMARY OF EXAMPLE EMBODIMENTS

An example embodiment may include a setting tool having a long cylinder with a thru bore having a first undercut and a second undercut, an uphole end and a downhole end, a top adaptor coupled to the uphole end having a bore, a cylinder head coupled to the downhole end having a through bore, a powercharge chamber piston slideably disposed within long cylinder thru bore, being located proximate to the top adaptor, and having a bore, and at least one o-ring seal slideably circumferentially engaged with the thru bore, a bottom metering piston slideably disposed within the long cylinder thru bore, downhole from and couple to the powercharge chamber piston, having at least one o-ring seal slideably circumferentially engaged with the thru bore, a piston rod coupled to and located downhole from the bottom metering piston, slideably engaged with the cylinder head thru bore, having a neck portion proximate to the bottom metering piston, and having at least one o-ring seal slideably circumferentially engaged with the cylinder head, in which the linear downhole movement of the powercharge piston, bottom metering piston, and piston rod can set a radially expandable seal, separate from the said seal, and then equalize pressure within the long cylinder with the wellbore using first undercut, second undercut, and piston rod neck portion coming into contact with respective o-ring seals after a predetermined downhole distance relative to the long cylinder is traversed.

The example embodiment may include a crosslink connection coupled to the downhole end of the piston rod. It may include a crosslink coupled to the crosslink connection and slideably engaged in a slotted mandrel, the slotted mandrel being coupled to the bottomhole end of the long cylinder. It may include a crosslink housing coupled to the crosslink. It may include a setting sleeve coupled to the crosslink housing. The long cylinder thru bore, the top adaptor bore, and the powercharge chamber piston bore may define a pressure chamber. It may include a powercharge disposed within said pressure chamber. It may include the bottom metering piston having a metering thru bore adapted to meter oil as the bottom metering piston travels downhole within the long cylinder.

An example embodiment may include a system for setting a bridge plug having a cablehead assembly, further comprising a wireline connected to the uphole end of a fish neck assembly, a casing collar locator 700 coupled to the downhole end of the fish neck assembly, a quick change assembly 600 coupled to the downhole end of the casing collar locator, a firing head assembly coupled to the downhole end of the quick change assembly, a settling tool assembly coupled to the downhole end of the firing head assembly, further comprising a long cylinder with a thru bore having a first undercut and a second undercut, an uphole end and a downhole end, a top adaptor coupled to the uphole end having a bore, a cylinder head coupled to the downhole end having a through bore, a powercharge chamber piston slideably disposed within long cylinder thru bore, being located proximate to the top adaptor, and having a bore, and at least one o-ring seal slideably circumferentially engaged with the thru bore, a bottom metering piston slideably disposed within the long cylinder thru bore, downhole from and couple to the powercharge chamber piston, having at least one o-ring seal slideably circumferentially engaged with the thru bore, a piston rod coupled to and located downhole from the bottom metering piston, slideably engaged with the cylinder head thru bore, having a neck portion proximate to the bottom metering piston, and having at least one o-ring seal slideably circumferentially engaged with the cylinder head, a setting sleeve coupled to the piston rod, wherein the setting sleeve slides as the piston rod slides, and a bridge plug located proximate to the setting sleeve and coupled to the long cylinder, wherein the bridge plug position is fixed in comparison to the setting sleeve.

An example embodiment may include a setting tool apparatus comprising a substantially cylindrical body with a center axis, a thru bore a first undercut, and a second undercut, a first cylindrical plug coupled to the uphole end of the cylindrical body and having a bore adapted to accept a portion of a power charge, a first piston slideably disposed within the first chamber and having an inner bore adapted to accept a portion of a power charge with a first o-ring seal against the cylindrical body thru bore, a mandrel extending normal from the first piston in a first direction, a second piston slideably disposed in the cylindrical body thru bore, coupled to the first piston mandrel, having a second o-ring seal with the cylindrical body thru bore, having a mandrel extending downhole with a neck portion proximate to the second piston and a regular diameter portion extending downhole, a second cylindrical plug coupled to the bottomhole end of the cylindrical body and having a thru bore with the second mandrel disposed therein with a third o-ring seal between the second cylindrical plug thru bore and the second mandrel.

The cylinder body thru bore, the cylindrical plug first piston bore, and the first piston bore may define a pressure chamber for a power charge. The first piston and second piston may move relative to the cylindrical body along the axis in a first direction. It may include a slotted mandrel coupled to a shear stud is coupled to the end of the second mandrel. It may include an expandable plug coupled to the shear stud. The expandable plug may be a bridge plug. The second piston may include a metering vent, wherein a fluid can enter the pressure chamber. A first fluid reservoir may formed by the first piston and the cylindrical body. A second fluid reservoir may be formed by the second piston and the cylindrical body. The movement downhole of the first piston, second piston, and second piston mandrel will compromise the first o-ring seal, the second o-ring seal, and the third o-ring seal when the plurality of o-ring seals slideably interfere with the first undercut, second undercut, and neck portion, respectively.

An example embodiment may include a method for setting a plug in a borehole including activating a firing head within a setting tool, starting a gas pressure generating chemical reaction, pressurizing a chamber located within a cylinder with the generated gas pressure, moving a piston disposed within the cylinder in a first axial direction with the generated gas, moving the cylinder in the first axial direction with the generated gas, expanding a seal radially against an inner wall of a borehole casing, separating the seal from the setting tool, relieving the gas pressure in the chamber when the moving piston travels a predetermined linear distance.

It may include placing a setting tool in a borehole at a predetermined location for installing a bridge plug. It may include equalizing pressure of a first quantity of oil within the setting tool with the wellbore pressure by moving the piston the predetermined linear distance in the first axial direction. It may include equalizing pressure of a first quantity of gas within the setting tool with the wellbore pressure by moving the piston the predetermined linear distance in the first axial direction. Separating may include shearing a shear stud coupled between a setting tool and a radially expanded seal. It may include removing the setting tool from the borehole after setting a bridge plug. The radially expanded seal may be a bridge plug. The radially expanded seal may be a packer.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Figure 1:
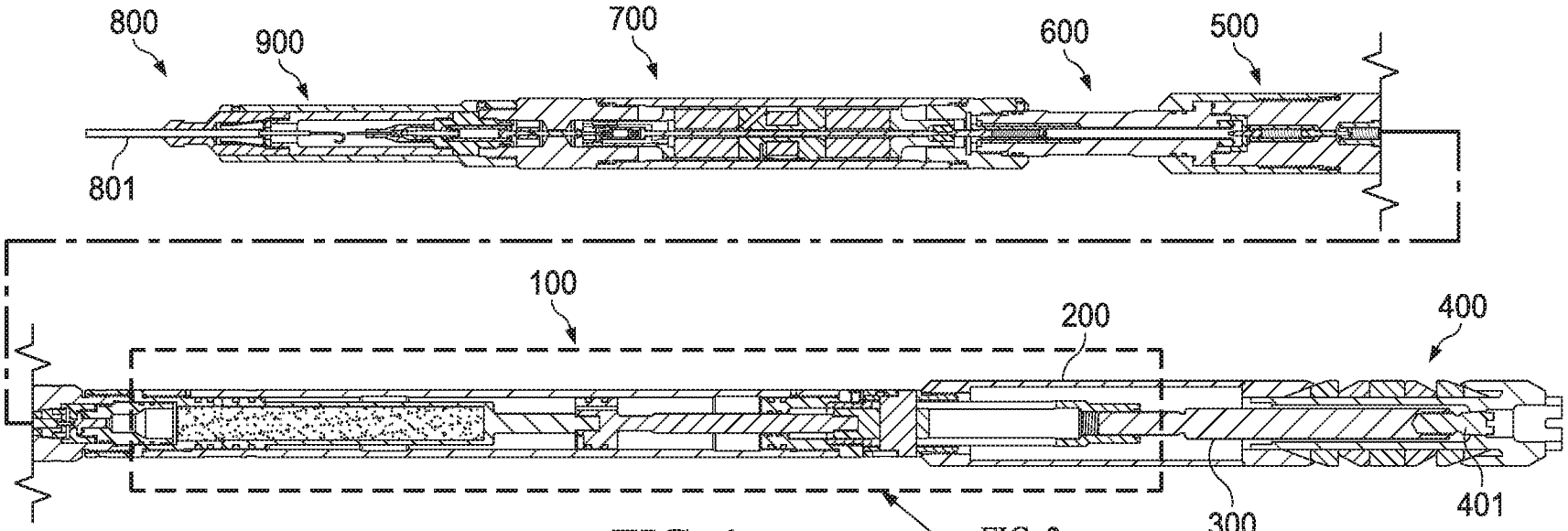
FIG. 1 depicts a cross-sectional side view of a tool string.

An example embodiment is shown in FIG. 1 includes a cablehead assembly 800 which has a wireline 801 coupled to the uphole end of a fish neck assembly 900. A casing collar locator 700, sometimes abbreviated CCL, is located downhole from and coupled to the downhole end of the fish neck assembly 900. A quick change assembly 600 is located downhole from and coupled to the downhole end of the casing collar locator assembly 700. A firing head assembly 500 is located downhole from and coupled to the downhole end of the quick change assembly 600. A setting tool assembly 100 is located downhole from and coupled to the downhole end of the firing head assembly 500. The downhole end of the setting tool assembly 100 is coupled to a setting sleeve 200 and a tension mandrel 300. The tension mandrel 300 is coupled to a bridge plug 400 using a shear stud 401.

In operation a signal from the wireline 801 causes a signal to the firing head assembly 500 that ignites a chemical power charge. The expanding gas generated from the power charge causes the setting tool assembly 100 to mechanically extend in such a way that the setting sleeve 200 moves downhole relative to the tension mandrel 300, which stays stationary. The setting sleeve 200 mechanically collapses the bridge plug 200, which causes it to expand and seal off the casing in which the tool string is located. After the bridge plug 200 is expanded, sufficient stress builds up in the shear stud 401 to cause it to separate from the bridge plug. Once separated, the rest of the tool string can be moved uphole while the bridge plug stays in place in the casing.

Figure 2:
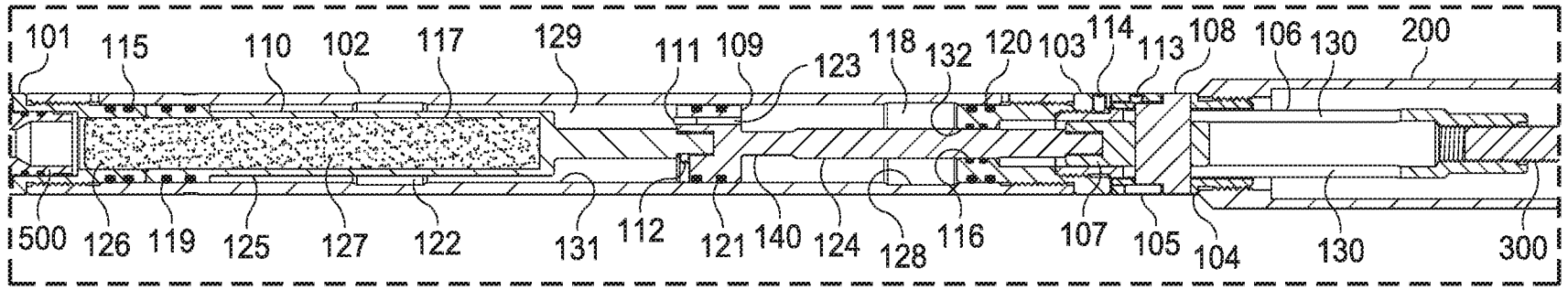
FIG. 2 depicts a cross-sectional side view of a setting tool.

FIG. 2 shows a close up view of the setting tool assembly 100. On the uphole side (left side, or top side depending on its orientation) there is a top adaptor 101 configured to couple to a quick change assembly 500. The top adaptor 101 is sealed to the interior of the long cylinder 102 via o-rings 115. Long cylinder 102 has an axial inner thru bore 131 that extends the length of long cylinder 102. The downhole portion of the top adaptor 101 has a bore 126 that forms an uphole end of a pressure chamber. A power charge chamber piston 110 is located within the long cylinder 102, downhole from the top adaptor 101. The long cylinder 102 has a piston head 125 that is sealed to the interior of the long cylinder 102 via o-rings 119. The long cylinder 102 has a bore 127 extending from its uphole end. Bore 127 forms the bottomhole end of a pressure chamber. Power charge 117 is located within bore 126 and bore 127.

Long cylinder 102 has a first undercut 122 and a second undercut 128.

A bottom metering piston 109 is coupled to the power charge chamber piston 110 and held in place with set screw 112. The bottom metering piston 109 is sealed to the interior of the long cylinder 102 via o-rings 121. The bottom metering piston 109 has a thru hole 123 that acts as a bleed port. A nylon plug 111 initially seals the uphole end of thru hole 123 prior to setting. The piston rod 124 extends downhole from the bottom metering piston 109 and is coupled to the crosslink connection 107. Piston rod 124 extends thru bore 132 of cylinder head 103. Thru bore 132 has o-rings 116 that seal against the majority of the length of piston rod 124. Piston rod 124 has a neck portion 140 located proximate to the bottom metering piston 109. The volume between piston rod 124, the interior of long cylinder 102, cylinder head 103, and bottom metering piston 109 is an oil reservoir and is typically filled with oil during assembly.

Cylinder head 103 is coupled to the downhole end of long cylinder 102. Cylinder head 103 is sealed to the interior of long cylinder 102 using o-rings 120. Cylinder head 103 is sealed to the exterior of the piston rod 124 via o-rings 116. Cylinder head 103 is coupled to the slotted mandrel 106 and further held in place to slotted mandrel 106 using set screw 114. The crosslink connection 107 is slideably engaged within the slotted mandrel 106. Slotted mandrel 106 is coupled to the tension mandrel 300.

Crosslink retention ring 105 is couples the crosslink housing 104 to the crosslink 108 using set screw 113.

Crosslink 108 and crosslink housing 104 are slideably engaged about the exterior of slotted mandrel 106. Crosslink 108 is slideably engaged with the slots 130 of the slotted mandrel 106. Crosslink housing 104 is coupled to the setting sleeve 200.

Operating the described embodiment includes assembling the tool string, lowering it into a wellbore, using the casing collar locator assembly 700 to accurately determine the position of the tool string, positioning the bridge plug 400 at a desired location within the wellbore, igniting the power charge 117 via a signal from the wireline 801 to the firing head assembly 500, extending the setting tool assembly 100 using the gases from the power charge 117, setting the bridge plug 400 with the setting sleeve 200 moving downhole while the tension mandrel 300 remains stationary, shearing the shear stud 401, venting the power charge gases via undercuts 126, 127, and neck 140, then pulling the depressurized tool string uphole. An advantage of this example embodiment is that the setting tool assembly self bleeds the power charge gases, therefore the setting tool isn't pressurized with 10-20 ksi of gas when it is removed from the wellbore.

The volume defined by the power charge chamber piston 110, the interior of long cylinder 117, and the bottom metering piston 109 is an oil reservoir 129 that is left empty upon installation. The tool string is lowered downhole until the bridge plug is at a predetermined downhole position. A command through the wireline 801 instructs the firing head assembly 500 to ignite the power charge 117. The power charge 117 ignition produces gases at high pressure, which expands against bores 126, 127, and the interior of long cylinder 102. The expansion will start to move the combination of power charge chamber piston 110, bottom metering piston 109, piston rod 124, crosslink connection 107, crosslink retention ring 105, crosslink housing 104, and setting sleeve 200 downhole. When the power charge chamber piston 110 moves downhole due to the gas release from the ignited power charge 117, the pressure in the reservoir 118 increases until the nylon plug 111 pops out into the oil reservoir 129, thus allowing oil to move uphole via thru hole 123. Thru hole 123 is sized to provide a metering effect as the oil moves uphole, thus slowing the rate that the combination of power charge chamber piston 110, bottom metering piston 109, piston rod 124, crosslink connection 107, crosslink retention ring 105, crosslink housing 104, and setting sleeve 200 moves linearly downhole. The downward movement will cause the bridge plug 400 to radially expand as the setting sleeve 200 moves downhole versus the tension mandrel 300 remaining stationary. After setting the radially expanded bridge plug 400, the continuing downhole movement of the combination will cause the shear stud 401 to shear off. After shearing the shear stud 401, the combination will continue moving a predetermined linear distance downhole, at which point the o-rings 115 will disengage at undercut 122, o-rings 121 will disengage at undercut 128, and o-rings 116 will disengage at neck 140. At undercut 121 and 128, o-rings 115 and 121, respectively, cannot hold any pressure. O-rings 116 at neck 140 cannot hold pressure. The loss of the o-rings 115, 121, and 116 sealing ability results in the pressurized gases and the oil venting out of the setting tool assembly via slots 130 in the slotted mandrel 106.

Figure 3:
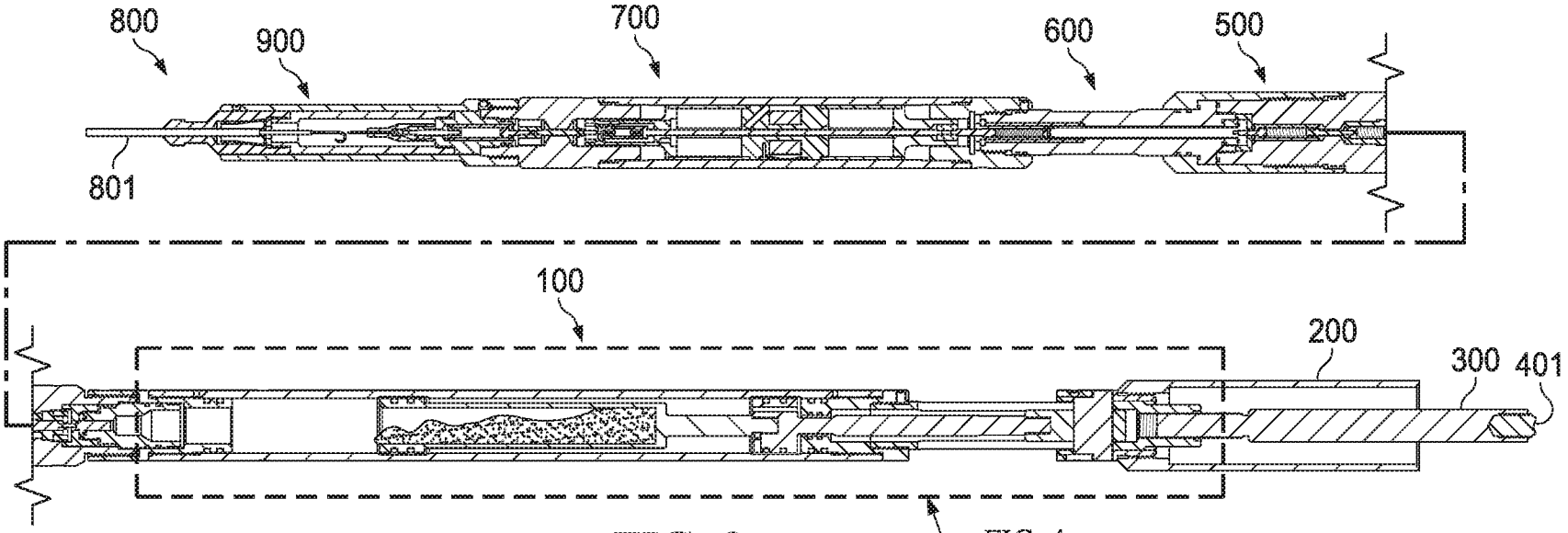
FIG. 3 depicts a cross-sectional side view of a tool string after deploying a bridge plug.

FIG. 3 shows the tool string after the setting tool assembly 100 has deployed. Cablehead assembly 800 has a wireline 801 coupled to the uphole end of a fish neck assembly 900. A casing collar locator 700 is located downhole from and coupled to the downhole end of the fish neck assembly 900. A quick change assembly 600 is located downhole from and coupled to the downhole end of the casing collar locator assembly 700. A firing head assembly 500 is located downhole from and coupled to the downhole end of the quick change assembly 600. A setting tool assembly 100 is located downhole from and coupled to the downhole end of the firing head assembly 500. The downhole end of the setting tool assembly 100 is coupled to a setting sleeve 200 and a tension mandrel 300. Since the setting operation has already occurred, the tension mandrel has sheared stud 401 and is separated from the bridge plug.

Figure 4:
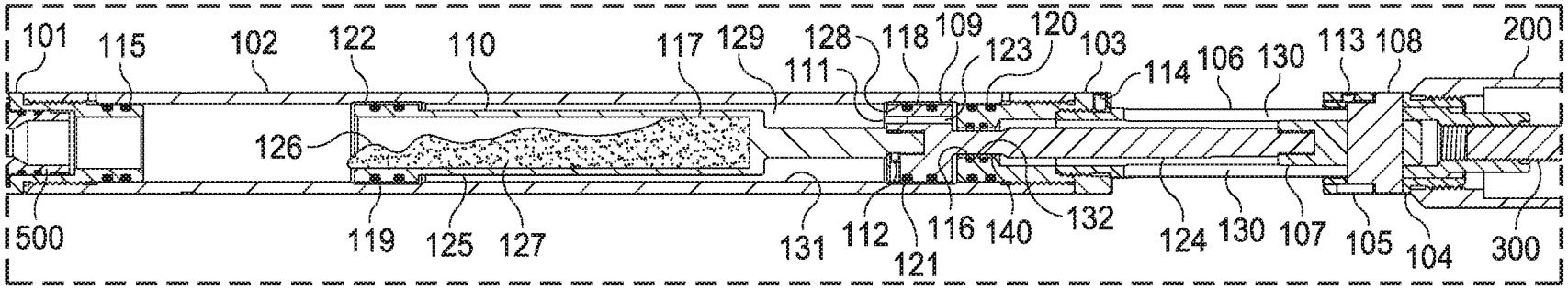
FIG. 4 depicts a cross-sectional side view of a setting tool.

FIG. 4 shows in detail what happens within the setting tool assembly 100 after the bridge plug is installed in the wellbore. Top adaptor 101 remains in place. The power charge chamber piston 110, bottom metering piston 109, piston rod 124, crosslink connection 107, crosslink retention ring 105, crosslink housing 104, and setting sleeve 200 have slideably moved downhole in relation to the long cylinder 102. The slotted mandrel 106, which is coupled to the long cylinder 102 via cylinder head 103 and set screw 114, is stationary. Since the tension mandrel 300 is coupled to the slotted mandrel 106, it has also remained stationary.

O-rings 115, 120, and 116 are no longer sealing because they are in contact with undercuts 122, 128, and neck 140, respectfully. Therefore, all gas and oil pressure has been relieved through the o-rings 115, 120, and 116 and through the slots 130 in slotted mandrel 106 to the borehole.

A bridge plug is used in the examples disclosed herein, however several other tools could be used in this application, such as packers, which may be deployed using a setting tool assembly as disclosed herein.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. An apparatus for setting a radially expandable seal in a wellbore comprising:

a long cylinder with a thru bore having a first undercut and a second undercut, an uphole end and a downhole end;

a top adaptor coupled to the uphole end having a bore;

a cylinder head coupled to the downhole end having a through bore;

a powercharge chamber piston slideably disposed within long cylinder thru bore, being located proximate to the top adaptor, and having a bore, and at least one o-ring seal slideably circumferentially engaged with the thru bore;

a bottom metering piston slideably disposed within the long cylinder thru bore, downhole from and coupled to the power charge chamber piston, having at least one o-ring seal slideably circumferentially engaged with the thru bore;

a piston rod coupled to and located downhole from the bottom metering piston, slideably engaged with the cylinder head thru bore, having a neck portion proximate to the bottom metering piston; and having at least one o-ring seal slideably circumferentially engaged with the cylinder head;

wherein the linear downhole movement of the power charge piston, bottom metering piston, and piston rod can set a radially expandable seal, separate from said radially expandable seal, and then equalize pressure within the long cylinder with the wellbore using first undercut, second undercut, and piston rod neck portion coming into contact with respective o-ring seals after a predetermined downhole distance relative to the long cylinder is traversed.

2. The apparatus of claim 1 further comprising a crosslink connection coupled downhole from and with the piston rod.

3. The apparatus of claim 2 further comprising a crosslink coupled to the crosslink connection and slideably engaged in a slotted mandrel, the slotted mandrel being coupled to the downhole end of the long cylinder.

4. The apparatus of claim 3 further comprising a crosslink housing coupled to the crosslink.

5. The apparatus of claim 4 further comprising a setting sleeve coupled to the crosslink housing.

6. The apparatus of claim 5 wherein the long cylinder thru bore, the top adaptor bore, and the power charge chamber piston bore define a pressure chamber.

7. The apparatus of claim 6 further comprising a power charge disposed within said pressure chamber.

8. The apparatus of claim 1 further comprising the bottom metering piston having a metering thru bore adapted to meter oil as the bottom metering piston travels downhole within the long cylinder.

9. The apparatus of claim 7 further comprising a radially expandable seal coupled to the slotted mandrel using a shear stud and located proximate to the setting sleeve, wherein the downhole linear movement of the setting sleeve collapses and expands the radially expandable seal.

10. The apparatus of claim 9 wherein the radially expandable seal is a packer.

11. The apparatus of claim 9 wherein the radially expandable seal is a bridge plug.

12. A system for setting a radially expandable seal in a wellbore comprising:

a cablehead assembly, further comprising a wireline connected to the uphole end of a fish neck assembly;

a casing collar locator coupled to the downhole end of the fish neck assembly;

a quick change assembly coupled to the downhole end of the casing collar locator;

a firing head assembly coupled to the downhole end of the quick change assembly;

a settling tool assembly coupled to the downhole end of the firing head assembly, further comprising:

a long cylinder with a thru bore having a first undercut and a second undercut, an uphole end and a downhole end;

a top adaptor coupled to the uphole end having a bore;

a cylinder head coupled to the downhole end having a through bore;

a power charge chamber piston slideably disposed within long cylinder thru bore, being located proximate to the top adaptor, and having a bore, and at least one o-ring seal slideably circumferentially engaged with the thru bore;

a bottom metering piston slideably disposed within the long cylinder thru bore, downhole from and coupled to the power charge chamber piston, having at least one o-ring seal slideably circumferentially engaged with the thru bore;

a piston rod coupled to and located downhole from the bottom metering piston, slideably engaged with the cylinder head thru bore, having a neck portion proximate to the bottom metering piston; and having at least one o-ring seal slideably circumferentially engaged with the cylinder head;

a setting sleeve coupled to the piston rod, wherein the setting sleeve slides as the piston rod slides;

a radially expandable seal located proximate to the setting sleeve and coupled to the long cylinder, wherein the radially expandable seal position is fixed in comparison to the setting sleeve.

13. The apparatus of claim 12 further comprising a crosslink connection coupled to the downhole end of the piston rod.

14. The system of claim 13 further comprising a crosslink coupled to the crosslink connection and slideably engaged in a slotted mandrel, the slotted mandrel being coupled to the bottomhole end of the long cylinder.

15. The system of claim 14 further comprising a crosslink housing coupled to the crosslink.

16. The system of claim 15 further comprising a setting sleeve coupled to the crosslink housing.

17. The system of claim 16 wherein the long cylinder thru bore, the top adaptor bore, and the powercharge chamber piston bore define a pressure chamber.

18. The system of claim 17 further comprising a powercharge disposed within said pressure chamber.

19. The system of claim 12 further comprising the bottom metering piston having a metering thru bore adapted to meter oil as the bottom metering piston travels downhole within the long cylinder.

20. The system of claim 12 wherein the radially expandable seal is a packer.

21. The system of claim 12 wherein the radially expandable seal is a bridge plug.

22. A setting tool apparatus comprising:

a substantially cylindrical body with a center axis, a thru bore having a first undercut, and a second undercut;

a first cylindrical plug coupled to an uphole end of the cylindrical body and having a bore adapted to accept a portion of a power charge;

a first piston slideably disposed within a first chamber and having an inner bore adapted to accept a portion of a power charge with a first o-ring seal against the cylindrical body thru bore;

a mandrel extending normal from the first piston in a first direction;

a second piston slideably disposed in the cylindrical body thru bore, coupled to the first piston mandrel, having a second o-ring seal with the cylindrical body thru bore, having a mandrel extending downhole with a neck portion proximate to the second piston and a regular diameter portion extending downhole, a second cylindrical plug coupled to a bottomhole end of the cylindrical body and having a thru bore with the second mandrel disposed therein with a third o-ring seal between the second cylindrical plug thru bore and the second mandrel.

23. The apparatus of claim 22 wherein the cylinder body thru bore, the cylindrical plug first piston bore, and the first piston bore define a pressure chamber for a power charge.

24. The apparatus of claim 22 wherein the first piston and second piston moves relative to the cylindrical body along the axis in a first direction.

25. The apparatus of claim 22 further comprising a slotted mandrel coupled to a shear stud is coupled to the end of the second mandrel.

26. The apparatus of claim 25 further comprising an expandable plug coupled to the shear stud.

27. The apparatus of claim 26 wherein the expandable plug is a bridge plug.

28. The apparatus of claim 22 the second piston further comprising a metering vent, wherein a fluid can enter the pressure chamber.

29. The apparatus of claim 22 wherein a first fluid reservoir is formed by the first piston and the cylindrical body.

30. The apparatus of claim 29 wherein a second fluid reservoir is formed by the second piston and the cylindrical body.

31. The apparatus of claim 22, wherein the first piston, second piston, and second piston mandrel will compromise the first o-ring seal, the second o-ring seal, and the third o-ring seal when the plurality of o-ring seals slideably interfere with the first undercut, second undercut, and neck portion, respectively.

* * * * *